United States Patent [19]

Villa-Real

[11] 4,347,804

[45] Sep. 7, 1982

[54] MONO-DISC ROTATORY MEDICATION REMINDER

[75] Inventor: Antony-Euclid C. Villa-Real, Las Vegas, Nev.

[73] Assignee: Medi-Timer Corporation, Las Vegas, Nev.

[21] Appl. No.: 120,865

[22] Filed: Feb. 12, 1980

[51] Int. Cl.[3] ..... B65D 5/72; G09F 9/00

[52] U.S. Cl. ..... 116/308; 206/459; 206/534; 368/89

[58] Field of Search ..... 116/308; 215/219, 228, 215/365

[56] References Cited

U.S. PATENT DOCUMENTS

| | | | |
|---|---|---|---|
| Re. 22,570 | 11/1944 | Lux | 116/308 X |
| 2,739,564 | 3/1956 | North | 116/308 |
| 2,817,451 | 12/1957 | Giles et al. | 116/308 X |
| 3,263,647 | 8/1966 | Murphy et al. | 116/308 X |
| 3,921,568 | 11/1975 | Fish | 116/308 |
| 4,002,258 | 1/1977 | Curry | 215/219 X |

FOREIGN PATENT DOCUMENTS

| | | | |
|---|---|---|---|
| 163309 | 6/1949 | Austria | 116/308 |
| 1937 | of 1894 | United Kingdom | 116/308 |

*Primary Examiner*—Daniel M. Yasich

*Attorney, Agent, or Firm*—Sughrue, Mion, Zinn, Macpeak & Seas

[57] ABSTRACT

A simple mechanically manipulatable two-component interacting device for use as an effective medication time intake reminder having a stationary outer ring component having a circularly running clocklike numerical indicia that are equally interspaced between each succeeding numeral ranging from 1 to 12 is disclosed. The inner rotatory disc has fixed interval spacings between the "LAST DOSE" arrow indicia and the "NEXT DOSE" arrow indicia depending upon the required application such as the time interval called for in the administration of each particular medication. It is also disclosed and preferred that each rotatory disc for each respective time interval application be differently color coded to easily distinguish one from the other.

1 Claim, 20 Drawing Figures

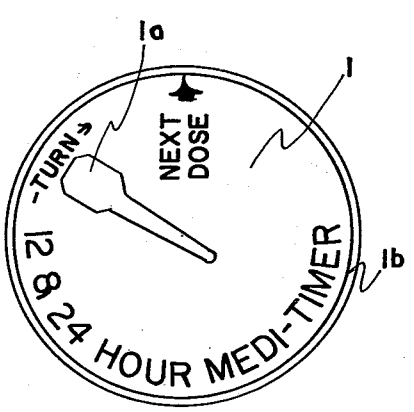
FIG. 4
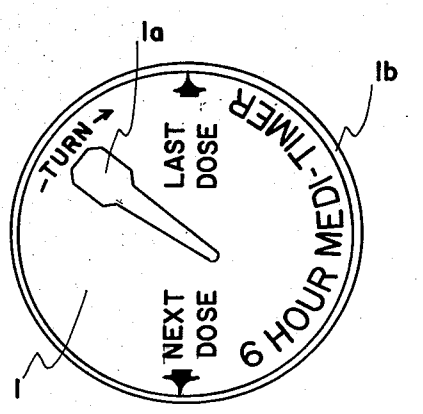
FIG. 5
FIG. 6
FIG. 7
FIG. 9
FIG. 11
FIG. 10
FIG. 8

MONO-DISC ROTATORY MEDICATION REMINDER

BACKGROUND OF THE INVENTION

It is of utmost importance to provide to hospitals, pharmacies and individual homes around the world with simple, economical and easy to manipulate medication time intake reminder for effective use of medical professionals assisting their patients, friends and relatives helping the patients, and, for optimal aid to patients themselves in the proper administration of both singular and multiple medications that are scheduled to be taken at different time intervals involving both prescription and non-prescription drugs. It is also important to have the abovementioned ideal reminder handy for use by travelers as well as for use by office personnel during the administration of various medications involving different time intervals and various time frames. However, this need in this area of mass application has not yet been properly solved or made available in the market to the general public as well as to professionals on a worldwide scale.

Several patents have been filed in the United States Patent Office in an effort to solve this human therapeutic need, however, the ones that have been issued such as U.S. Pat. Nos. 493,851; 535,610; 576,833; 557,616; 619,078; 623,171; 1,129,384; 1,211,737; 2,042,351; 2,066,183; 2,111,637; 2,565,095; 3,446,179 are structurally and mechanically more complicated. Patent numbers 3,450,949; 2,767,680; 2,706,564; 2,739,740; 3,960,713 are structurally different, and comparatively less effective than the instant invention, as far as the overall combination of simplicity, functional completeness, ease of operation, economical to mass-produce, dispensibility, and aesthetics are concerned. This present invention is an alternative invention to my concurrently applied for invention entitled "Mono-Ringed Rotatory Medication Reminder."

SUMMARY OF THE INVENTION

The main object of the present invention is to provide an effective two-component medication time intake reminder that can be economically mass-produced, distributed, stored and marketed, as well as to provide a simple structural design that can bring forth ease of operation by the user while at the same time solving the common confusion especially arising from the usage of multiple medications with a variety of time interval administration to the patient.

The instant invention includes among its objects to positively enable indication of the time which the last and next dosage of medicine was and is to be taken. Such function is achieved by the relative placement of the inner rotatory disc, which indicates dosage, with respect to the outer stationary clockface indicia. Thus, by selectively orienting the former with respect to the latter the user will readily observe when the next dosage of medicine should be taken.

Basically, the present device consists of two main components, an outer stationary annular member which contains numerical indicia ranging from 1 to 12 and arranged in a regular clockwise fashion; each successive numerical indicia being equally interspaced between each other and a rotatory inner disc member. The said disc component is provided with a singular or multiple outer protrusions for usage as turning tab portions of the said rotatory disc. The word "TURN" is marked just below the said turning tab portion with a corresponding arrow indicia directed in a clockwise manner. There are several varieties of functional capabilities involved in each kind of rotatory disc depending upon the particular use relevant to the set medication time-intake intervals are concerned. For example, there are differences in the indicia on the face of each of the particular rotatory discs; a "3-HOUR TIMER" rotatory disc having the "LAST DOSE" indicia with its corresponding inwardly pointed arrow interspaced in a three-hour clockwise interval in relation to the "NEXT DOSE" indicia with its corresponding arrow; a "4-HOUR TIMER" having the "LAST DOSE" indicia with its corresponding arrow interspaced in the four-hour clockwise interval in relation to the "NEXT DOSE" indicia with its corresponding arrow; the "6-HOUR TIMER" having the "LAST DOSE" indicia with its corresponding arrow interspaced in a six-hour clockwise interval in relation to the "NEXT DOSE" indicia with its corresponding arrow; an "8-HOUR TIMER" having the LAST DOSE" indicia with its corresponding arrow interspaced in an eight-hour clockwise interval in relation to the "NEXT DOSE" indicia with its corresponding arrow. In the "12 and 24-HOUR TIMER", only the "NEXT DOSE" indica with its corresponding arrow appears and the "LAST DOSE" markings omitted.

In actual operation, since the said disc can be engaged in firm but rotatory interrelationship with the stationary clocklike component mentioned above, the mere differences in each particular clockwise interval between the "LAST DOSE" and the "NEXT DOSE" depending upon whether the rotatary disc is for a "3-HOUR TIMER", a "4-HOUR TIMER", "6-HOUR TIMER", and an "8-HOUR TIMER", will bring forth a correspondingly fixed shifting of the various "LAST DOSE" arrow indicia and the "NEXT DOSE" arrow indicia in relation to the clocklike stationary component when said disc is rotated in a clockwise fashion. In other words, if an individual is using a "3-HOUR TIMER" since the distance between the "LAST DOSE" arrow indicia and the "NEXT DOSE" arrow indicia is fixed, it is, therefore, possible that when the "LAST DOSE" arrow indicia appears directed toward eleven o'clock, the "NEXT DOSE" for that medication becomes automatically set at two o'clock as indicated by the "NEXT DOSE" arrow indicia, and, when two o'clock comes and that particular medication is taken, the user simply turns the rotatory "3-HOUR TIMER" disc clockwise setting the "LAST DOSE" arrow indicia at two o'clock and then the "NEXT DOSE" arrow indicia becomes automatically set at five o'clock and the operation continuous in the same fashion of set space shifting as long as the user is using the said "3-HOUR TIMER" and taking that particular medication. A "4-HOUR TIMER" rotatory disc having the "LAST DOSE" arrow indicia directed at eleven o'clock automatically sets the "NEXT DOSE" arrow indicia at three o'clock, and, when three o'clock comes and the user takes this particular medication contained therein, he simply shifts the said rotatory disc aligning the "LAST DOSE" arrow indicia at three o'clock and thus automatically shifting the "NEXT DOSE" arrow indicia at seven o'clock, and, the process can continue as long as the user is using this particular medication with "4-HOUR TIMER". A "6-HOUR TIMER" rotatory disc having the "LAST DOSE" arrow indicia pointed at eleven o'clock will have the "NEXT DOSE" arrow indicia pointing at five o'clock, and when the latter time comes, and he takes the medication contained therein, he simply turns the said rotatory "6-HOUR TIMER" disc clockwise, aligning the "LAST DOSE" arrow indicia to five o'clock, thereby automatically setting the "NEXT DOSE" arrow indicia to eleven o'clock, and again the process can go in a similar fashion as long as he is using this particular "6-HOUR TIMER". The "8-HOUR TIMER" having the "LAST DOSE" arrow indicia pointing at eleven o'clock will have the "NEXT DOSE" arrow indicia pointing at seven o'clock, and, when seven o'clock comes, after taking this particular medication contained therein, he simply rotates the said "8-HOUR TIMER" rotatory disc aligning the "LAST DOSE" arrow indicia to seven o'clock, thereby automatically adjusting the "NEXT DOSE" arrow indicia to one o'clock, and, again the process continues in the same fashion in a clockwise direction as long as the said "8-HOUR TIMER" is being used. However, in the case of the "12 & 24-HOUR TIMER" as explained earlier, it has only the "NEXT DOSE" indicia with its corresponding arrow indicia printed, and, therefore, if the user is taking medication on a "12-HOUR" interval and begins taking that particular medication at eleven o'clock, he does not have to turn the rotatory disc if the "NEXT DOSE" arrow indicia has already been set at eleven o'clock; he simply waits for eleven o'clock and takes this particular medication. However, if the user is taking medication on a "24-HOUR" interval and the "NEXT DOSE" arrow indicia has already been set at eleven o'clock, again, he does not have to turn the said rotatory "12 & 24-HOUR TIMER" disc, but then he will have to wait until the "24-HOUR" time has elapsed before taking that particular medication again. In order to differentiate in a more effective way between "3-HOUR TIMER", "4-HOUR TIMER", "6-HOUR TIMER", "8-HOUR TIMER" and "12 & 24-HOUR TIMER" it is preferable to make contrasting color codings in each individual rotatory discs respectively. For example, the color coding designated for a "3-HOUR TIMER" rotatory maybe red, "4-HOUR TIMER" rotatory with a contrasting color such as yellow, and the "6-HOUR TIMER" rotatory disc maybe colored green, and "8-HOUR TIMER" rotatory disc maybe colored orange and a "12 & 24-HOUR TIMER" rotatory disc maybe colored blue. It is to be understood that these preferred color codings mentioned above are only serving as examples and not absolute designation of color codings in each respective rotatory timer discs. Other colors can be used to differentiate color contrast that can be effective for both professionals and consumer usage.

These various rotatory discs can be used in conjunction with the proper mating structures of the stationary component of the invention; it could be applied to a corresponding mating stationary component that can be glued or adhesively attached on top of existing medicine cap, fill boxes and on flat surfaces of medicine bottles or it could be engaged with a corresponding mating stationary component that can be attached firmly over existing medication caps or it could be attached to a corresponding stationary mating component that can be used as a total replacement to existing medicine caps.

BRIEF DESCRIPTION OF THE DRAWINGS

FIG. 4 is a top elevational view of the "4-hour timer" rotatory disc showing all the proper indicia and the outer circumferential ridge.

FIG. 5 is a top elevational view of the "6-hour timer" rotatory disc showing all the proper indicia and the outer circumferential ridge.

FIG. 6 is a top elevational view of the "8-hour timer" rotatory disc showing all the proper indicia and the outer circumferential ridge.

FIG. 7 is a top elevational view of the "12 and 24-hour timer" rotatory disc showing all the proper indicia and the outer circumferential ridge.

FIG. 8 is a perspective view of the device with an alternative attachment means in an upside down fashion and illustrating three equally spaced lateral walls of the stationary component.

FIG. 9 is a perspective view of the top and side view of the device of FIG. 8.

FIG. 10 is a cross-sectional view of FIG. 9 showing the stationary component, rotatory disc and upstanding tab portion.

FIG. 11 is a top elevational view of the bottom side of FIGS. 2*b* and 3*b* showing the adhesive pad and adhesive.

DETAILED DESCRIPTION OF DRAWINGS

Figure 1:
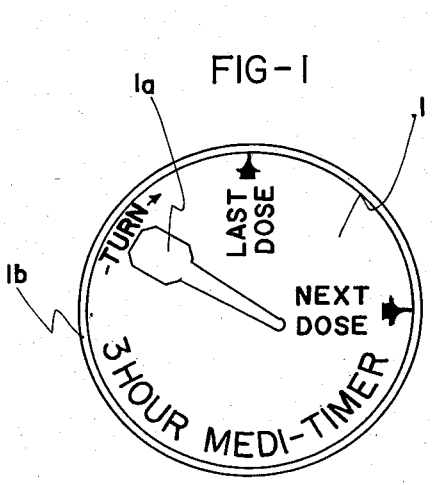
FIG. 1 is a top elevational view of the rotatory "3-hour timer" disc having the various indicia markings on its face.
Figure 1A:
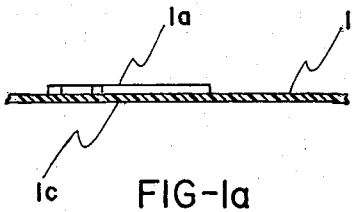
FIG. 1*a* is a cross-sectional view of the rotatory disc as shown in FIG. 1.
Figure 2:
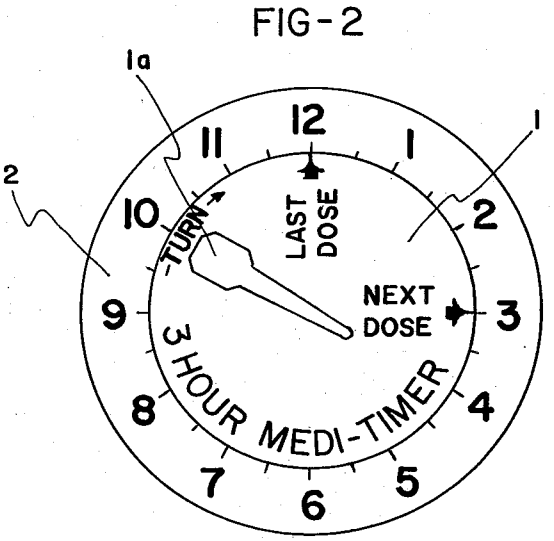
FIG. 2 is a top elevational view of the rotatory disc of FIG. 1 engaged with the stationary component of the invention having clocklike numerals ranging from 1 to 12 that are equally interspaced between each other in a clockwise direction.
Figure 2A:
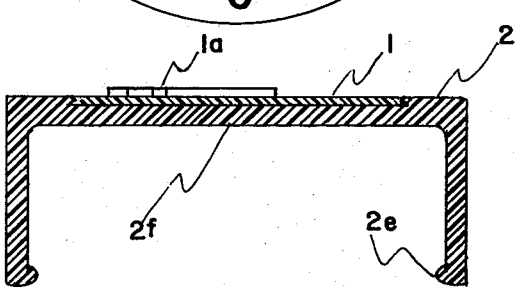
FIG. 2*a* is a cross-sectional view of the device of FIG. 2 showing in section the lateral depending walls of the stationary component of the invention that can fit in firm gripping action over an existing medicine container cap of corresponding size. The turning tab of the rotatory disc is also shown protruding vertically.
Figure 2B:
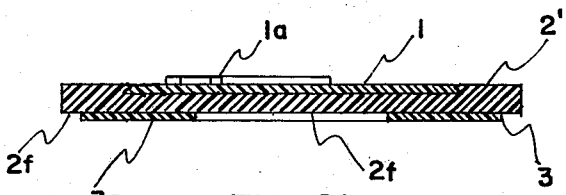
FIG. 2*b* is a cross-sectional view of a modification of the device of FIG. 2 showing an adhesive pad and adhesive for attachment to an existing medicine container cap of corresponding size. The turning tab of the rotatory disc is also shown protruding vertically.
Figure 3:
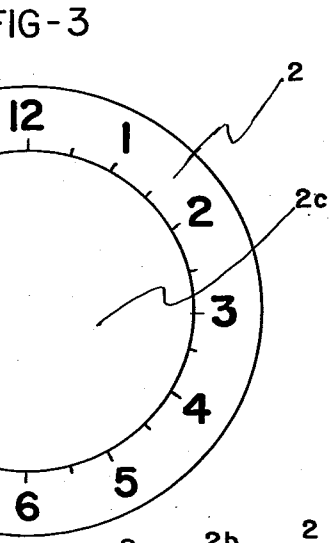
FIG. 3 is a top elevational view of the stationary component having clocklike numberals ranging from 1 to 12, each numeral equally interspaced between each other in a clockwise direction.
Figure 3A:
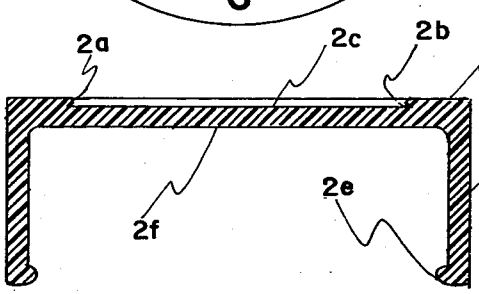
FIG. 3*a* is a cross-sectional view of the stationary component of FIG. 3 showing an annular ridge and groove for receiving the rotatory disc and lateral depending walls to fit in firm gripping action over an existing medicine container cap of corresponding size.
Figure 3B:
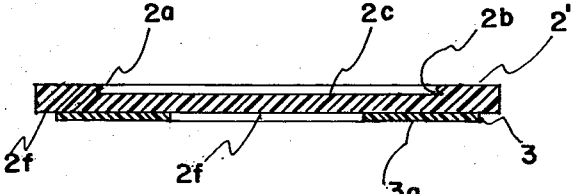
FIG. 3*b* is a cross-sectional view of a modification of the stationary component of FIG. 3 showing an adhesive pad and adhesive for attachment to an existing medicine container cap of corresponding size.

Referring to FIGS. 1, 1*a*, 2, 2*a*, 3 and 3*b*, a rotatory annular disc 1 of the instant invention is shown having indicia thereon. An upstanding protuberance 1*a* is located on annular disc 1 to aid in turning or rotating the disc. An inner annular ridge 1*b* is provided to engage and receive the disc to stationary central portion and allow for rotary or relative sliding movement thereof. Underside flat surface 1*c* of the annular disc can be seen in juxtaposed position to top flat surface 2*c* in FIGS. 2*a* and 3*a* which further includes a depending annular wall 2*d* and gripping annular protuberance 2*e* to aid in gripping over an existing medicine cap. The bottom side of the stationary portion 2 has a roof portion 2*f*. At the top side edges is provided an annular ridge 2*a* and an annular groove 2*b* which cooperate to receive and hold the annular edge of the disc member 1 in a snap-fit arrangement whereby the disc member 1 can be rotated and the desired time-interval indicia located or positioned relative to stationary component 2. FIGS. 2*b* and 3*b* show a modification of the device wherein 2' is a disc-like device for attachment to a medicine container.

The materials from which the respective elements are formed are preferably yieldable to the extent normally inherent in plastics and any known or conventional plastics material may be used in this invention.

Various time intervals printed on annular disc member 1 are shown at FIGS. 4–7, to be used with stationary component of FIG. 3*a*, depending upon the desired or prescribed time interval for the medication. In addition to numerical indicia, color codings may be used to distinguish different timer devices according to applicability for effective use in systematic as well as specific time interval of dosage administration of multiple medications. FIGS. 2*a* and 2*b* show the annular disc member coupled to the stationary component both in sectional view cut at the widest diameter of the medication reminder device of FIG. 2, and said cut made across the central section of the upstanding protuberance 1*a*.

At FIGS. 9, 10 is shown various views of the medication reminder as attached to a medicine container 6 having an existing cap 4. The medication reminder is shown to be snap-fitted over and around the existing medicine bottle cap at these figures. An attachment means for the medication reminder is seen at FIG. 8 wherein the stationary component is provided with a plurality of equidistantly spaced depending walls 2*d*. The spacing 5 between the walls 2*d* exposes the existing part of the medicine cap so as to provide an additional gripping surface for the user's hand or fingers during the opening of the medicine container.

The drawing FIG. 7 is similar to FIGS. 4–6 with the exception that the rotatory disc member 1 does not have the "LAST DOSE" indicia since it is to be used as a 12 or 24 hour reminder.

A further alternative means of attaching the medication reminder of the present invention is shown at FIGS. 2*b*, 3*b* wherein the stationary component 2 is provided on its bottom surface with a pad 3 coated with adhesive 3*a*. The pad 3 can be of elastomeric foam such as polyurethane or the like, and, having a coating or layer of pressure-sensitive adhesive thereon. The adhesive coating may be provided with a conventional protective, peelable sheet member, not shown. A modified form of the pad and adhesive is shown at FIG. 11 wherein the pad 3 (not shown) and adhesive 3*a* for said pad are annular in form.

Figures 12, 13, 14, 15:
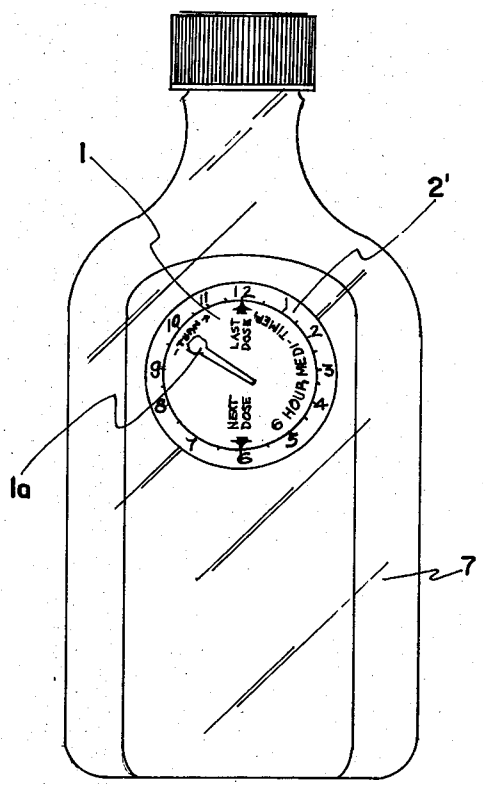
FIG. 12 is a perspective view of the instant invention as applied directly to the top of a medicine container.
FIG. 13 is a perspective view of the instant invention as applied to the side of a medicine bottle.
FIGS. 14 and 15 are perspective views of the instant invention as applied to various shaped medicine containers.

FIGS. 12 thru 15 illustrates the abovesaid modified form of attachment of the present invention by means of adhesive means and shown to be adhesively applied on the flat surfaces of different medicine containers. All essential elements 1, 1*a* and 2 of the medication time-intake-reminder device are shown. At FIG. 12 is a "4-HOUR TIMER" medication time-intake-reminder device, shown adhesively attached on top of existing medicine cap covering medicine container of shape 6; at FIG. 13 is a "6-HOUR TIMER" medication time-intake-reminder device, is shown adhesively attached to the flat surface of medicine bottle 7; at FIG. 14 is an "8-HOUR TIMER" medication time-intake-reminder device, shown adhesively attached on top of circular pill box 8; at FIG. 15 is "12 and 24-HOUR TIMER" medication time-intake-reminder device adhesively attached on top of a rectangular pill box 9.

Various changes may be made within the purview of this invention in the form, details, proportions and arrangement or parts without departing from the spirit of the invention to those skilled in the art and no undue limitations are to be inferred or implied from the foregoing disclosure.

I claim:

1. A medication dosage time-intake reminder device for a medicine container comprising:

a stationary portion having a lower disc-like central surface, an upper and outer ring-like surface, and a ridge and groove portion between said surfaces, said upper and outer ring-like surface having time indicia thereon;

an inner annular disc member having an annual ridge means for engagement with said ridge and groove portion between said surfaces, said disc member rotatable within said ridge and groove portion and within said disc-like central surface and the top surface of said disc member flush with said upper ring-like surface;

medication dosage indicating means on said disc member whereby upon rotation of said disc member with respect to the stationary portion, the medication dosage indicating means may be aligned with the time indicating means to indicate the time for the next dose administration; and an annular protuberance on said depending annular wall for engaging a medicine container whereby said device may be firmly attached to said medicine container cap.

* * * * *